US007367300B2

(12) United States Patent
Meyer

(10) Patent No.: US 7,367,300 B2
(45) Date of Patent: May 6, 2008

(54) ELECTRIC VALVE DRIVE WITH A ROTATING ACTUATOR

(75) Inventor: Johannes Meyer, Karlsfeld (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/450,325

(22) Filed: Jun. 12, 2006

(65) Prior Publication Data

US 2006/0278190 A1 Dec. 14, 2006

Related U.S. Application Data

(63) Continuation of application No. PCT/EP2004/012432, filed on Nov. 3, 2004.

(30) Foreign Application Priority Data

Dec. 12, 2003 (DE) ..... 103 58 936

(51) Int. Cl.
*F01L 1/02* (2006.01)

(52) U.S. Cl. ..... 123/90.31; 123/90.15; 123/90.11

(58) Field of Classification Search ..... 123/90.11, 123/90.31, 90.15
See application file for complete search history.

(56) References Cited

U.S. PATENT DOCUMENTS

| | | | | |
|---|---|---|---|---|
| 5,327,856 | A * | 7/1994 | Schroeder et al. | 123/90.11 |
| 5,494,007 | A | 2/1996 | Schroeder et al. | |
| 5,873,335 | A | 2/1999 | Wright et al. | |
| 2002/0066176 | A1 | 6/2002 | Paasch et al. | |

FOREIGN PATENT DOCUMENTS

| | | | |
|---|---|---|---|
| DE | 198 60 451 | A1 | 6/2000 |
| DE | 101 40 461 | A1 | 2/2003 |
| EP | 0 347 211 | B1 | 6/1988 |
| EP | 1 136 660 | A1 | 9/2001 |
| EP | 1 144 813 | B1 | 10/2001 |
| FR | 2 608 675 | A1 | 6/1988 |
| FR | 2 834 118 | A1 | 6/2003 |
| WO | WO 03/019582 | A1 | 3/2003 |

OTHER PUBLICATIONS

International Search Report dated Feb. 3, 2005 including English Translation (Fourteen (14) pages).
German Search Report dated Dec. 7, 2004 (Four (4) pages).

* cited by examiner

*Primary Examiner*—Zelalem Eshete
(74) *Attorney, Agent, or Firm*—Crowell & Moring LLP

(57) ABSTRACT

Valve drive for an internal combustion engine having a valve which is axially displaceable between an open position and a closed position and is prestressed by a locking spring in the direction of its closed position, in which a control shaft driven by an electric motor to pivot about a longitudinal axis, has a cam, provided for operating the valve a pressure element that can be pivoted about a pivot axis, and a spring element which prestresses the pressure element and exerts a torque on the control shaft via the pressure element. The mass moment of inertia of the pressure element relative to its pivot axis is greater than the mass moment of inertia of the control shaft and the cam relative to the longitudinal axis of the control shaft. The valve drive so configured provides greater electrical operating efficiency and permits valve actuation to be performed at lower electric motor rotation speeds.

14 Claims, 3 Drawing Sheets

ELECTRIC VALVE DRIVE WITH A ROTATING ACTUATOR

CROSS-REFERENCE TO RELATED APPLICATIONS

This application is a continuation of International patent application No. PCT/EP2004/012432 filed Nov. 3, 2004 which claims priority to German patent application No. 103 58 936.8 filed Dec. 12, 2003, the entire the disclosures of which are herein incorporated in their entireties.

BACKGROUND AND SUMMARY OF THE INVENTION

The present invention relates to a valve drive of an internal combustion engine that operates according to the "rotating actuator principle."

Such a valve drive is known from German Patent DE 101 40 461 A1. With traditional internal combustion engines, the camshaft is driven mechanically by the crankshaft via a control chain or a control belt. To increase the engine power and to reduce fuel consumption, a considerable advantage would be achieved by individually triggering the valves of the individual cylinders or at least the intake valves and outlet valves of the individual cylinders. This is possible by means of an electromagnetic valve drive. In an electromagnetic valve drive, an "actuator unit" is assigned to each valve and/or each "valve group" of a cylinder. Different basic types of actuator units are currently being researched. In one basic type, an opening magnet and a closing magnet are assigned to one valve or one valve group. The valves can be displaced axially, i.e., opened and/or closed, by applying electric current to the magnets. However, such valve drives are difficult to control from the standpoint of control technology. With the other basic type, a control shaft with a cam is provided, whereby the control shaft can be pivoted back and forth by an electric motor. This is also referred to as the so-called "rotating actuator principle." In German Patent DE 101 40 461 A1 cited above, the cam acts on a rocker arm. Then the opening force generated by the cam is applied by the rocker arm to the valve. At the end of the control shaft, a lever-like element is also provided in the form of a "hand crank." Furthermore, a spring clip is also provided, having a protruding spring arm that presses against the lever-like element. The spring arm of the pivoting lever exerts a torque on the control shaft and/or on the cam. The torque depends on the position of the lever-like element, i.e., the pivot position of the control shaft.

As mentioned above, the control shaft together with the cam in the case of a valve drive like that described in German Patent DE 101 40 461 A1 pivots cyclically back and forth. A reversal of direction of rotation is thus occurring constantly. The electric motor here must accelerate the control shaft and the cam and the lever-like element attached thereto out of the resting state to a relatively high rotational speed. Although the electric motor is supported by the spring clip in opening the valve, it must work against the force of the locking spring, which requires a relatively high electric power. One essential problem here is that the electric motor "starts" from the resting state each time in acceleration of the control shaft, the cam and the lever-like element of the electric motor connected to the control shaft. It takes a certain amount of time with each cycle until the electric motor reaches a rotational speed at which the electric motor operates with a favorable electric efficiency. At low rotational speeds in particular, the efficiency of the electric motor is relatively unfavorable, resulting in a high power consumption.

The object of the present invention is to create an electric valve drive that operates according to the "rotating actuator principle" which is improved with regard to the electric power consumption.

The starting point for the present invention is a valve drive for an internal combustion engine with a valve that is arranged so that it is axially displaceable between an open position and a closed position. Due to a locking spring, the valve is prestressed in the direction of its closed position. Furthermore, a control shaft is provided with a cam which operates the valve. The control shaft is coupled to an electric motor that pivots the control shaft back and forth about a longitudinal axis. Furthermore, a pivotably mounted "pressure element" prestressed by a spring is provided. The pressure element prestressed by the spring exerts a torque on the control shaft. The torque exerted instantaneously on the control shaft depends on the pivot position of the cam. In the back and forth movement of the control shaft, the pressure element is also pivoted back and forth about its pivot axis.

The present invention is based on the finding that the power required for operation of the valve and/or the electric power required for valve operation depends to a significant extent on the ratio of the moments of mass inertia of the "pivotable valve drive components." The greater the mass moment of inertia of the control shaft and of the cam, the more power must be supplied by the electric motor for acceleration of the control shaft and the cam. In opening the valve, the acceleration of the control shaft and the cam is supported by the pressure element prestressed by the spring. When the valve is closed, then the spring is maximally stressed. It can be demonstrated in an experiment that the mass moment of inertia of the pressure element in particular and/or the mass moment of inertia formed by the spring and the pressure element have a decisive effect on the electric power required for operation of the electric motor. A good "electric efficiency" is achieved when the mass moment of inertia of the pressure element in relation to its pivot axis is greater than the mass moment of inertia formed by the control shaft and the cam in relation to the longitudinal axis of the control shaft.

Thus, the pressure element is designed to be "more solid" than would actually be necessary for transmission of the prestressing force generated by the spring.

In designing the electric motor, it is advantageous not to set the maximum rotational speed of the electric motor too high. In fact, the maximum rotational speed of the electric motor could be reduced with an increase in the mass moment of inertia of the control shaft and the cam. As already mentioned, however, the dynamics of the valve drive decreases with an increase in the mass moment of inertia of the control shaft and the cam because the mass moment of inertia of the control shaft and the cam must first be accelerated electrically by the electric motor and then must additionally be accelerated mechanically by the springs because the mass moment of inertia of the control shaft and of the cam must also be accelerated even in the "stable end positions," i.e., from the resting positions of the control shaft. Likewise, this mass moment of inertia must be accelerated electrically in the case of a "mini stroke operation."

However, an increase in the mass moment of inertia of the pressure element has the advantage that the pressure element need not be accelerated out of the resting position by the electric motor alone when opening the valve but instead is also moved by the spring element.

During an initial phase of the opening procedure of the valve, first the control shaft and the cams are accelerated by the electric motor to a certain speed without the valve already being opened. During this initial phase, the pressure element is also accelerated and thus stores a certain amount of rotational energy. The actual opening movement of the valve, when the valve is opened against the locking spring force of the valve, begins during the second phase. The energy required for opening the valve is applied primarily by the spring element and the "kinetic energy" stored in the pressure element.

By increasing the mass moment of inertia of the pressure element, more kinetic energy is stored in the pressure element accordingly. This part of the energy need no longer be stored in the camshaft. In other words, according to this invention, a portion of the energy required for opening the valve is "shifted" from the camshaft to the pressure element. This permits a reduction in the maximum control shaft rotational speed required for valve opening. The increase in the mass moment of inertia of the pressure element acts like an increase in the mass moment of inertia of the control shaft in this operating state. Since the "rotational actuator" must be accelerated electrically out of the two end positions, a low mass moment of inertia is favorable with regard to actuator dynamics as well as with regard to electric power consumption, in particular at the start of the acceleration movement.

Another advantage achieved with the present invention lies in the fact that the average rotational speed of the electric motor with this invention is shifted into a higher rotational speed range. Therefore, the ohmic losses are reduced, especially in acceleration of the electric motor from low rotational speeds, thus resulting in an improvement in overall electric efficiency. The total power consumption declines and the amount of lost heat to be dissipated is thus also reduced.

According to one embodiment of the present invention, the spring element is a torsion spring. This may be a torsion spring rod whose first end is fixedly clamped, e.g., being attached to an actuator housing with the pressure element attached to its other end and protruding essentially perpendicularly away from the torsion spring rod. The torsion spring rod may be arranged in parallel with respect to the control cam which is thus a very space-saving arrangement.

The "elevated" mass moment of inertia of the pressure element is preferably achieved by a mass concentration at the end distal from the torsion spring. This yields a relatively high mass moment of inertia with a comparatively low total mass of the pressure element. The pressure element may be manufactured from a plate-shaped component, for example, and may have a closed contour with a recess in the central area. The pressure element may be a punched part. The recess may be punched out of the central area in particular.

As already mentioned, according to the present invention, the mass moment of inertia of the pressure element in relation to its pivot axis is greater than the mass moment of inertia formed by the control shaft and the cam and in relation to the longitudinal axis of the control shaft. An especially favorable mass moment of inertia ratio is obtained when the mass moment of inertia of the pressure element in relation to its pivot axis is greater by a factor in the range between 1.7 and 2.3 than the mass moment of inertia formed by the control shaft and the cam and in relation to the longitudinal axis of the control shaft.

Other objects will become apparent for one skilled in the art on seeing the description and claims.

DESCRIPTION OF THE DRAWINGS

Figure 1:
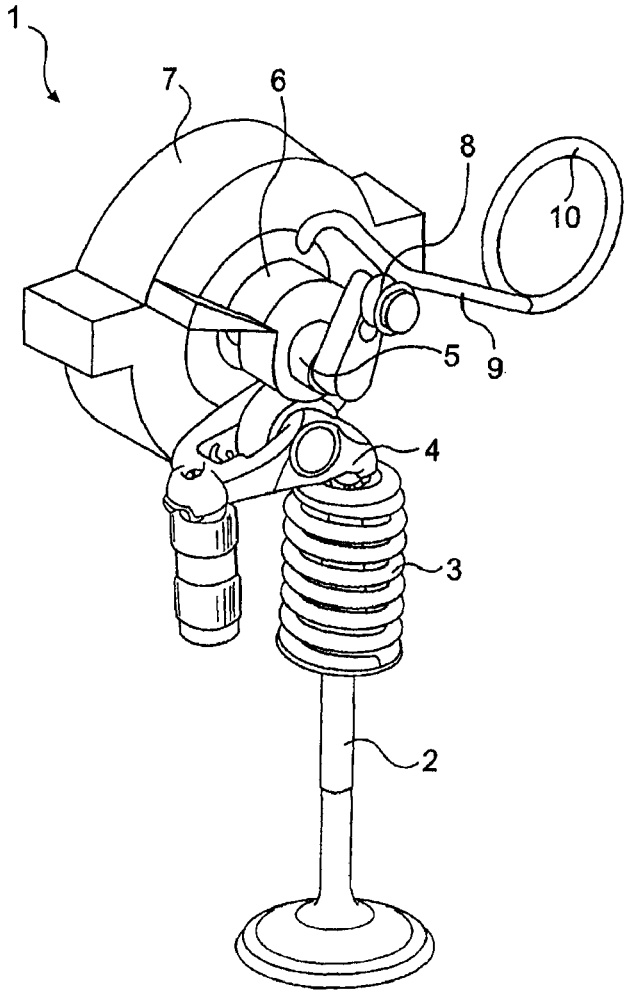
FIG. 1 PRIOR ART
FIG. 1 shows an electric valve drive with a rotating actuator according to the state of the art as known from DE 101 40 461 A1.

FIG. 1 shows a rotating actuator such as that known from DE 101 40 461 A1. The content of DE 101 40 461 A1 is herewith fully incorporated into the content of the present patent application. It is herewith pointed out explicitly that all features described in DE 101 40 461 A1 are also the subject matter of the present patent application.

FIG. 1 shows an electric valve drive 1 based on the rotating actuator principle. An axially displaceable valve 2 is prestressed by a locking spring 3 into the closed position shown here. A rocker arm 4 is arranged at the shaft end of the valve 2. Furthermore, a control shaft 5 is provided with a cam 6 acting on the rocker arm 4. The control shaft 5 with the cam 6 is pivoted back and forth by an electric motor 7. Furthermore, a lever-like element 8 is provided, an arm 9 of a spring clip 10 pressing against this element. The spring clip 10 thus exerts a torque on the control shaft 5, this torque being a function of the pivot position of the control shaft 5. In the back and forth movement of the control shaft 5 and the cam 6, the arm 9 of the spring clip 10 is also moved according to the movement of the lever-like element 8. In the case of the rotating actuator illustrated in FIG. 1, the mass moment of inertia of the arm 9 of the spring clip 10 is comparatively low in comparison with the control shaft 5 and the cam 6.

A reduction in the motor power required for valve control, i.e., a reduction in electric power required for valve control, can be achieved by using an "arm" and/or a "pressure element" that cooperates with the lever element 8 and has a "higher" mass inertia. In this way, the maximum motor rpm and/or idling rpm of the electric motor required for the valve control may be reduced. In other words, this results in an improved overall electric efficiency.

Figure 2:
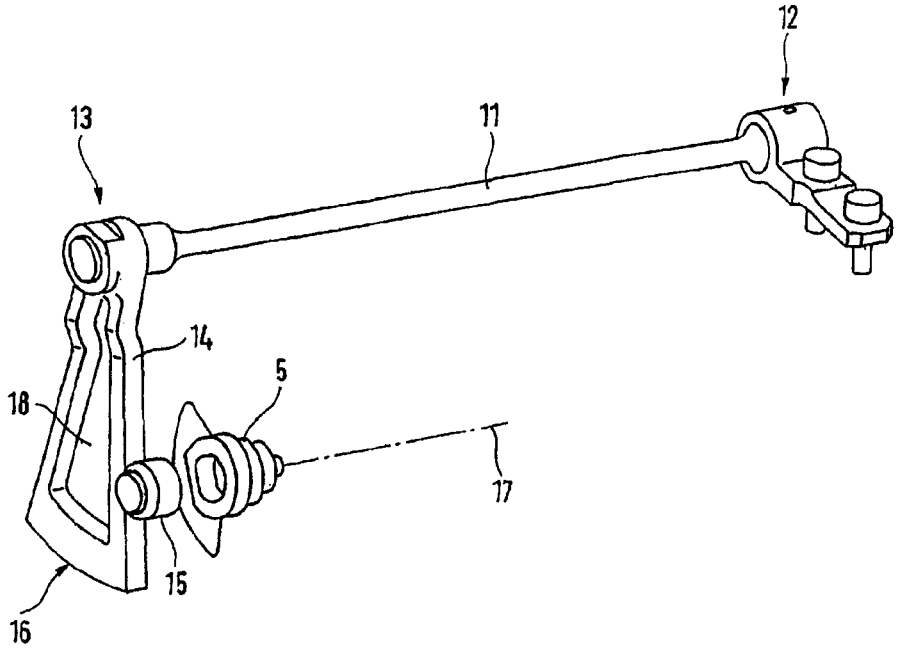
FIG. 2 shows a pressure element under prestress by a torsion spring according to an embodiment of the present invention.

FIG. 2 shows an improved arrangement according to the present invention. Instead of the spring clip shown in FIG. 1, the arrangement according to FIG. 2 has a torsion rod 11, one end 12 of which is fixedly clamped, e.g., on an actuator housing (not shown in detail here). On the other end 13 of the torsion rod 11, a "pressure element 14" is attached, pressing against a lever-like element 15 that is fixedly connected to the control shaft 5 and thus is pivoted back and forth together with the control shaft 5 by an electric motor (not shown in FIG. 2). The lever-like element 15 is arranged eccentrically with respect to the control shaft 5. The pressure element 14 has a high mass moment of inertia with respect to its pivot axis, i.e., with respect to the longitudinal axis of the torsion rod 11, this mass moment of inertia being achieved primarily through a local "mass concentration" in the area of the free end 16 of the pressure element. The mass moment of inertia of the pressure element 14 is larger than the mass moment of inertia formed by the control shaft 5 and the lever-like element 15 and in relation to the longitudinal axis 17. However, the pressure element has a comparatively small total mass, which is achieved by means of a recess 18 in the central area of the pressure element 14. The pressure element 14 is thus formed by a closed contour.

Figure 3:
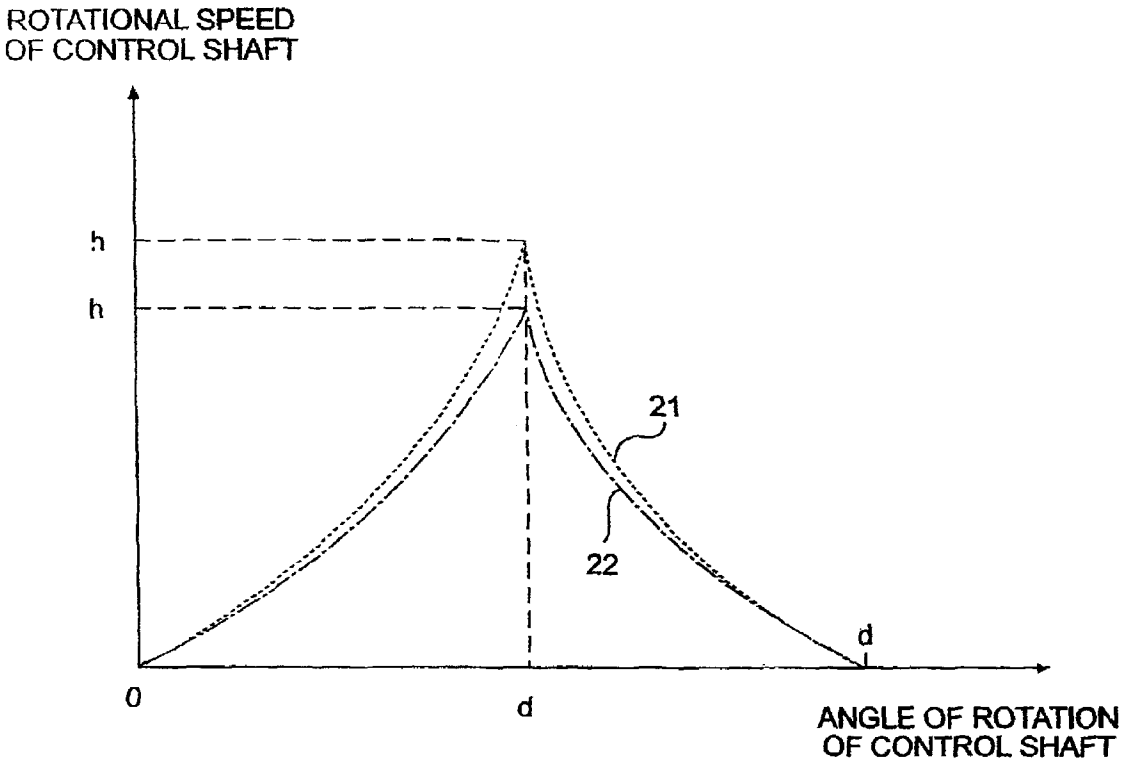
FIG. 3 shows an rpm-angle-of-rotation diagram to illustrate the potential energy savings achieved with the present invention.

FIG. 3 shows a diagram in which the rotational speed of the control shaft is plotted as a function of the angle of rotation of the control shaft. Qualitatively, curve 21 corresponds to the conditions in a rotating actuator according to the state of the art as illustrated in FIG. 1, for example. The shape of curve 22 corresponds qualitatively to a rotating actuator according to the present invention. When the valve is completely closed and the control shaft and the cam are in their resting positions, this corresponds to an angle of rotation of 0. In the range between 0 and $\forall_1$ the control shaft and the cam are accelerated by the electric motor and by the spring, i.e., the pressure element. In the angle of rotation range between 0 and $\forall_1$ approximately ¼ or ⅓ of the mechanical energy stored in the spring is converted into kinetic energy of the pressure element. The valve is still completely closed up to the angle of rotation $\forall_1$. When expressed figuratively, the control shaft and the cams get momentum in the angle of rotation range between 0 and $\forall_1$ and then open the valve against the force of the locking spring (see FIG. 1) in the angle of rotation range between $\forall_1$ and $\forall_2$.

In the state of the art, the pressure element has a comparatively low mass inertia. Thus the control shaft and the cam connected to it must be accelerated to a relatively high rotational speed $n_1$.

The maximum rotational speed required for valve operation can be reduced to $n_2$ if the mass moment of inertia of the pressure element is increased in relation to the pivot axis of the pressure element, in particular if it is greater than the mass moment of inertia formed by the control shaft and the cam and in relation to the longitudinal axis of the control shaft. As FIG. 3 shows, the "actuator motor curve" is much flatter. With respect to the maximum motor rotational speed $n_1$ and/or $n_2$, the "average" operating rotational speed at which the electric motor operates is greater than that in the state of the art when working with a pressure element having a greater mass inertia. In absolute terms, the average working rotational speed of a rotating actuator according to the present invention may in fact be smaller. However, the average operating rotational speed is greater in relation to the maximum motor rotational speed and/or on the idling rotational speed. The ratio between the average operating rotational speed and the maximum motor rotational speed $n_1$ and/or $n_2$ is in turn the decisive factor in the "economic viability" of the electric motor. On the whole the overall electric efficiency is better due to an increase in the mass inertia of the pressure element, i.e., with a flatter characteristic line for the rotational speed over the angle of rotation.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A valve drive for an internal combustion engine having a valve which is axially displaceable between an open position and a closed position and is prestressed by a locking spring in the direction of its closed position, comprising:

a control shaft;

an electric motor arranged to bi-directionally rotate the control shaft about a control shaft longitudinal axis;

a cam driven by the control shaft and disposed to control opening and closing of the valve as the control shaft rotates;

a pressure element arranged to pivot about a pivot axis; and a spring element, wherein the pressure element is arranged to bi-directionally pivot about the pressure element pivot axis as the control shaft bi-directionally rotates, the spring element applies a torque to the control shaft via the pressure element, and a mass moment of inertia of the pressure element about the pressure element pivot axis is greater than a mass moment of inertia of the control shaft and the cam about the control shaft longitudinal axis.

2. The valve drive as claimed in claim 1, wherein the spring element is a torsion spring.

3. The valve drive as claimed in claim 1, wherein the spring element is a torsion spring rod which has a fixed first end and a second end free to rotate about the pivot axis, and the pressure element is located at the second end and protrudes radially outward from the second end.

4. The valve drive as claimed in claim 3, wherein the torsion spring rod is arranged parallel to the control shaft.

5. The valve drive as claimed in claim 1, further comprising:

a lever element arranged eccentrically on the control shaft, wherein the spring element torque is applied to the control shaft via pressure element contact on the lever element.

6. The valve drive as claimed in claim 3, further comprising:

a lever element arranged eccentrically on the control shaft, wherein the spring element torque is applied to the control shaft via pressure element contact on the lever element.

7. The valve drive as claimed in claim 1, whereby the center of mass of the pressure element is located relative to the pressure element pivot axis with respect closer to a radially distal end of the pressure element than to the pivot axis.

8. The valve drive as claimed in claim 6, whereby the center of mass of the pressure element is located relative to the pressure element pivot axis with respect closer to a radially distal end of the pressure element than to the pivot axis.

9. The valve drive as claimed in claim 1, wherein the pressure element has a closed contour with a central recess.

10. The valve drive as claimed in claim 8, wherein the pressure element has a closed contour with a central recess.

11. The valve drive as claimed in claim 1, wherein the pressure element is a punched part.

12. The valve drive as claimed in claim 10, wherein the pressure element is a punched part.

13. The valve drive as claimed in claim 1, wherein the mass moment of inertia of the pressure element relative to the pressure element pivot axis is between 1.7 and 2.3 times greater than the mass moment of inertia of the control shaft and the cam relative to the control shaft longitudinal axis.

14. The valve drive as claimed in claim 8, wherein the mass moment of inertia of the pressure element relative to the pressure element pivot axis is between 1.7 and 2.3 times greater than the mass moment of inertia of the control shaft and the cam relative to the control shaft longitudinal axis.

* * * * *